US005491945A

United States Patent [19]

Meirick

[11] Patent Number: 5,491,945

[45] Date of Patent: Feb. 20, 1996

[54] THERMALLY INSULATED COLUMNAR STRUCTURE FORMED WITH ISOLATED FRONT AND BACK FACES

[76] Inventor: Herbert J. Meirick, Rte. 3 228E, Mount Vernon, Mo. 65712

[21] Appl. No.: 213,239

[22] Filed: Mar. 16, 1994

[51] Int. Cl.[6] ..... E04C 2/288

[52] U.S. Cl. ..... 52/309.11; 52/405.3; 52/795.1

[58] Field of Search ..... 52/309.11, 309.9, 52/309.12, 309.14, 309.17, 405.1, 405.2, 405.3, 405.4, 562, 565, 563, 407.1, 809, 90.1, 92.1, 639, 642, 723, 725, 727, 795.1

[56] References Cited

U.S. PATENT DOCUMENTS

| | | | |
|---|---|---|---|
| 202,413 | 4/1878 | Corrigan . | |
| 278,585 | 5/1883 | Murphy et al. . | |
| 484,734 | 10/1892 | Hadley . | |
| 522,592 | 7/1894 | Hall . | |
| 2,311,479 | 2/1943 | Shugart | 52/568 X |
| 3,204,381 | 9/1965 | Perreton | 52/407.1 X |
| 4,027,445 | 6/1977 | Nickerson | 52/309.12 X |
| 4,073,111 | 2/1978 | Warren | 52/407.1 X |
| 4,115,953 | 9/1978 | Brosenius . | |
| 4,363,351 | 12/1982 | Eriksen . | |
| 4,716,700 | 1/1988 | Hagemeyer . | |
| 4,942,702 | 7/1990 | Lemasson | 52/309.12 X |
| 5,077,948 | 1/1992 | Olson et al. . | |
| 5,129,203 | 7/1992 | Romero | 52/309.9 X |
| 5,184,423 | 2/1993 | McCarty . | |

FOREIGN PATENT DOCUMENTS

| | | | |
|---|---|---|---|
| 905089 | 7/1972 | Canada | 52/309.14 |
| 174882 | 3/1986 | European Pat. Off. | 52/309.12 |
| 429093 | 7/1967 | Switzerland | 52/405.2 |
| 4971 | of 1906 | United Kingdom | 52/405.3 |
| 1524530 | 9/1978 | United Kingdom | 52/405.1 |
| 2023215 | 12/1979 | United Kingdom | 52/309.12 |

*Primary Examiner*—Carl D. Friedman
*Assistant Examiner*—Yvonne Horton-Richardson
*Attorney, Agent, or Firm*—Kokjer, Kircher, Bowman & Johnson

[57] ABSTRACT

A structure formed with a hardened outer casing shaped with a rectangular cross-section. The outer casing may be formed of concrete which includes a wire mesh core shaped to maintain the rectangular cross-section. The outer casing includes front and back walls separated by an insulating core which includes at least two insulating layers, such as styrofoam, located adjacent the front and back faces. The insulating layers are spaced apart with shims to form a dead air space therebetween. The shims and insulating layers are penetrated with tie members which traverse the insulating core and are fastened to the wire mesh shell within the front and back faces thereof. The outer casing may be formed of concrete comprising a mixture of concrete powder, haydyte gravel, styrofoam balls, fiber mesh particles, water and an adhesive agent. The top, bottom and side walls are formed in a tongue and groove arrangement in order to secure adjoining members to one another. A separation crack is formed about central periphery of the top, bottom and side walls in order to isolate entirely the front and back faces from one another. This separation crack is formed along the apex of each tongue and along the base of each groove. Optionally, metal structural beams may be substituted for the shims to provide additional strength within each columnar member, such as when used to form a roof. Optionally, additional insulating layers and dead air spaces may be formed within the core.

21 Claims, 3 Drawing Sheets

THERMALLY INSULATED COLUMNAR STRUCTURE FORMED WITH ISOLATED FRONT AND BACK FACES

BACKGROUND OF THE INVENTION

1. Field of the Invention

The present invention generally relates to an apparatus for constructing thermally insulated structures, such as walls, roofs, doors, shutters and the like, which utilizes an insulated core to thermally isolate front and back walls from one another.

2. Description of the Related Art

In the past, structures have been proposed which improve the insulating characteristics of a building, for instance, by installing improved shutters and doors. In one such system (U.S. Pat. No. 4,363,351), a shutter assembly is constructed with opposed wooden panel members forming front and back faces for the shutter. The panel members form an air void therebetween which includes a single sheet of insulating material sandwiched between thermally reflective layers. Within the air void, air gaps are formed between the thermally reflective layers and the outer paneling members to provide an overall thermally insulated shutter. An alternative shutter is provided (U.S. Pat. No. 4,115,953), in which a plurality of shutters close to form a dead air gap between an exterior of the window and an interior of the shutter. The shutters of the '953 patent are formed with an insulating interior layer, such as plastic or wood which is sandwiched between wooden front and back shutter faces.

An insulating door has also been proposed (U.S. Pat. No. 5,184,423), in which a rigid insulating layer, is formed between rigid wooden structural panels. The wooden structural panels are sandwiched between facing panels formed of a durable resilient material such as plastic. An alternative door has been constructed (U.S. Pat. No. 5,077,948) with wooden backing supports provided along the top, bottom and sides of the door. These backing supports surround the body of the door which is filled with foam. The foam body and wooden backing supports are surrounded by front and back half shells formed of a polymer composite material.

However, past doors and shutters offer limited insulating characteristics since, in the majority of the above-discussed systems, the interior and exterior walls directly contact or are formed integrally with one another. Also, the entire interior surface of the front and back panels contact the inner insulating material. Hence, these prior systems transfer a certain amount of energy between the front and back panels, and thus from the outside of the structure through the core materials directly to the inside. Similarly, these structures release heat from the interior through the wall to the exterior surface thereof through the surrounding periphery edge pieces for each door and shutter.

The shutter of the '351 patent uses air gaps between the wooden front and back panels. However, these air gaps are located immediately against the wooden panels. The wooden panels exhibit very limited insulating characteristics. Thus, the front and back air gaps would receive significant amounts of thermal energy from the adjoining front and back panels. The shutter of the '351 patent forms its primary insulating layer as a single layer between the air gaps. This single insulating layer would experience the same type of energy transfer through its interior between the dead air gaps as discussed above. Therefore, the configuration of the '351 patent does not offer an optimal insulating characteristic.

Further, conventional walls and roofs which include wooden studs experience the same kind of energy transfer as noted above. While these walls and roofs include insulation, the wooden studs directly contact the interior and exterior surfaces of each wall. Hence, the studs, and metal nails therein, transfer energy directly between the interior and exterior wall surfaces. Consequently, the resulting insulation factor of the wall is reduced below the stated R-value of the insulation within the wall and roof and floor panels.

Moreover, each of the above-discussed structures exhibit a limited life and limited security. More directly, the above-discussed prior art systems are only useful during the life span of the wood used therein. As the wood begins to rot and deteriorate, so does the integrity of the wall, roof, door or shutter. Also, doors and shutters constructed of wood only offer limited protection against burglars. Further, wooden structures, doors, shutters, etc. warp.

A need remains in the building industry to improve the insulating characteristics of structures and to overcome the drawbacks discussed above and heretofore experienced. The subject invention meets this need.

SUMMARY OF THE INVENTION

It is an object of the present invention to provide a structure having a hardened exterior with isolated front and back faces surrounding a core to provide strong thermal insulating characteristics.

It is another object of the present invention to provide a thermally insulating structure constructed of multiple columnar members joined in a tongue and groove arrangement.

It is another object of the present invention to provide a thermally insulating structure which may be pre-fabricated to include internal support beams that remain isolated from front and back faces thereof.

It is another object of the present invention to provide an insulating structure which minimizes the transfer of thermal energy between interior and exterior faces of the structure.

It is another object of the present invention to provide a ceiling, floor and wall panel assembly that may be attached to trusses in such a manner as to provide a passage, such as for electrical lines, air currents and the like along the wall panels and through the ceiling panels and the trusses.

It is another object of the present invention to provide a thermally insulated door and window assembly.

It is another object of the present invention to provide a passive solar structure.

It is another object of the present invention to provide an envelope structure which does not present a fire hazard.

These and other objects are provided by a structure formed with a hardened outer casing shaped with a rectangular cross-section. The outer casing may be formed of concrete which includes a wire mesh core shaped to maintain the rectangular cross-section. The outer casing includes front and back walls separated by an insulating core which includes at least two insulating layers, such as styrofoam, located adjacent the front and back faces. The insulating layers are spaced apart with shims to form a dead air space therebetween. The shims and insulating layers are penetrated with tie members which traverse the insulating core and are fastened to the front and back faces thereof. The outer casing may be formed of a hard material, such as concrete comprising a mixture of concrete powder, haydyte gravel, styrofoam balls, fiber mesh particles, water and an adhesive agent. The top, bottom and side walls are formed in a tongue and groove arrangement in order to secure adjoining members to one another. A separation crack is formed about a central periphery of the top, bottom and side walls in order to isolate entirely the front and back faces from one another. This separation crack is formed along the apex of each tongue and along the base of each groove. Optionally, metal structural beams may be substituted for the shims to provide additional strength within each columnar member, such as when used to form a roof. Optionally, additional insulating layers and dead air spaces may be formed within the core.

BRIEF DESCRIPTION OF THE DRAWINGS

In the following description of the drawings, in which like reference numerals are employed to indicate like parts in the various views.

DETAILED DESCRIPTION OF THE INVENTION

Figure 1:
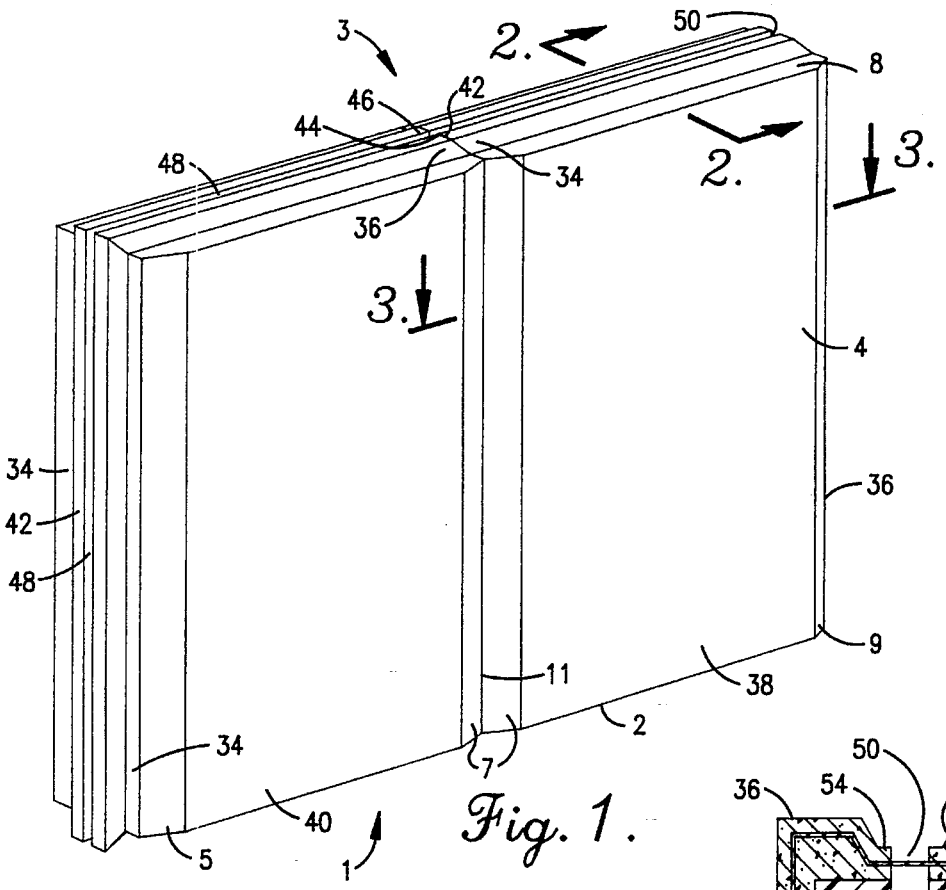
FIG. 1 illustrates a side elevational view of a group of columnar members according to the present invention fitted together.

FIG. 1 generally illustrates a preferred embodiment of the present invention in which a plurality of prefabricated columnar members or panels are united to form a wall, such as in a house. Each columnar member or panel is generally designated by the reference numeral 1 and is formed in a substantially rectangular shape. The columnar members or panels 1 are joined in a tongue and groove arrangement 3 and are formed to exhibit significant thermal insulation properties. Each columnar member 1 is constructed with a hardened outer casing 2 and may be made of concrete, wood and other hard materials which exhibit good thermal insulating characteristics. By way of example only, the outer casing 2 may be formed of a concrete mixture which includes concrete powder, fiber mesh particles, styrofoam particles (i.e., styrofoam balls) and a gravel composition having a high insulation factor. For instance, the gravel composition may be made of haydyte rock which exhibits a very good R-value. The mixture is combined with water and an adhesive agent, such as glue. This mixture may include one part concrete, three parts gravel, one-quarter part fiber mesh particles, two parts styrofoam particles, glue and water. Once formed, each columnar member/panel 1 is covered in a water sealant.

In FIG. 1, a leading side 34 of a first columnar member 38 is secured to a trailing side 36 of a second columnar member 40. A tongue and groove connection 42 and 44 is sealed with a sealing agent 46, such as caulking foam or the like which fills any voids between the tongue and groove 42 and 44. The sealing agent 46 is received within the separation cracks 48 and 50. As illustrated in FIG. 1, a front or interior face 4 of each panel 1 includes beveled edges 5, 7 and 9 proximate the leading and trailing edges 34 and 36 of each panel 1. The beveled edges 5, 7 and 9 extend along a length of corresponding edges and converge at a common intersection line 11 to form a notched recess. The beveled edges 5, 7 and 9 may be straight or curved, such as in a half-moon pattern. Once the wall panels 1 are installed, tape and sheet rock are plastered over and fill the notched recess to conceal the intersecting line 11 and the seam between wall panels 1.

Figure 2:
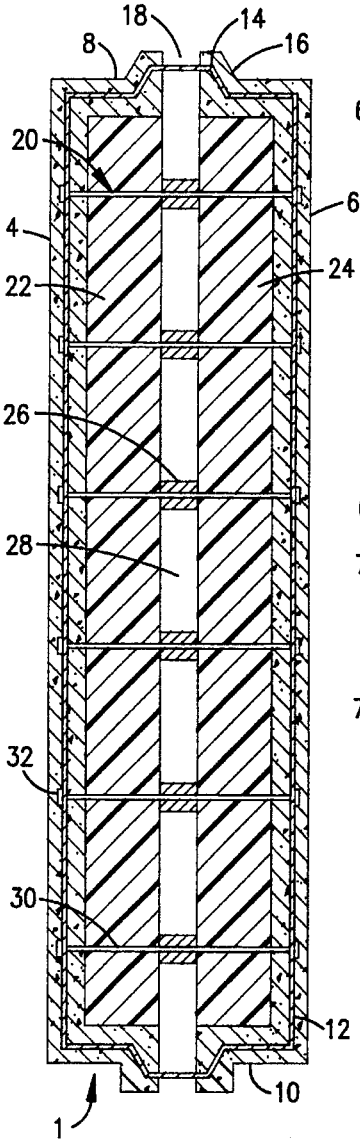
FIG. 2 illustrates a side sectional view of one columnar member according to the present invention taken along line 2—2 in FIG. 1.

FIG. 2 illustrates a side sectional view of a columnar member or panel 1 constructed with a concrete outer casing 2 having front and back faces 4 and 6, and top and bottom surfaces 8 and 10. The outer casing 2 may be formed with a substantially rectangular cross-section. If the outer casing 2 is formed of concrete, a wire mesh shell 12 is included therein. The wire mesh shell 12 may be formed with a diamond-shaped pattern and the like. The wire mesh shell 12 is formed with a substantially rectangular cross-section or the like to help maintain the shape of and provide supplemental support for the columnar member 1. Proximate the center of the top and bottom surfaces 8 and 10, the wire mesh shell 12 includes U-shaped intersecting ridges 14. The intersecting ridges 14 are formed within, and co-extensive with, intersecting tongues 16. Each intersecting tongue 16 projects outward along and extends parallel to a length of the top and bottom surfaces 8 and 10. By way of example only, the intersecting tongues 16 are received within corresponding recesses in the floor and ceiling mounts (not shown) to effect a sealed intersecting joist between the columnar members 1 and the floor and roof members.

Optionally, the intersecting tongue 16 may be formed with any desired cross-sectional shape. The intersection tongue 16 on the top surface 8 of the panel 1 is illustrated with a tapered cross-section. However, the intersection tongue 16 may alternatively be formed with a rectangular cross-sectional (such as on the bottom surface 10 of the panel 1 in FIG. 2), an arcuate cross-section and the like so long as the tongue provides the necessary support. The corresponding recess is formed with a corresponding cross-section.

The tongues 16 include separation cracks 18 extending along an apex thereof and in a direction parallel to a length of the top and bottom surfaces 8 and 10. The separation crack 18 represents a definite discontinuity in the outer casing 2 to separate the front and back faces 4 and 6 from one another in order to prevent the direct transfer of thermal energy, through the top and bottom surfaces 8 and 10, between the front and back faces 4 and 6 of each columnar member. The wire mesh shell 12 spans the separation crack 18 along the top and bottom surfaces 8 and 10, in order to maintain the structural integrity of the top and bottom surfaces 8 and 10, including the tongues 16.

The separation crack 18 may be any width so long as it adequately insulates the opposed sides of the surfaces 8 and 10 from one another. The width of the separation crack may be greater than, equal to, or less than the width of the dead air space 28. By way of example, the separation crack may be ⅛ inch to ¼ inch wide.

The outer casing 2 and wire mesh shell 12 encase an insulating core 20 which is formed with a substantially rectangular side cross-section and which functions to minimize the transfer of thermal energy between the front and back faces 4 and 6. The isolating core 20 includes front and back porous insulation layers 22 and 24, formed of a material such as styrofoam and the like. The front and back insulation layers 22 and 24 abut against and are secured to the front and back faces 4 and 6, respectively, to resist energy transfer therethrough and to support partially the faces. The front and back isolation layers 22 and 24 are separated from one another with shims 26 to form a dead air space 28 therebetween. The dead air space may have any desired width, such as ¼", ⅜", ½", ⅞", etc. The shims 26 may be formed in a hollow tubular arrangement and located in any desired pattern, such as every square foot, so long as they provide sufficient support to maintain the shape of the dead air space 28.

The insulating core 20 is secured to the wire mesh shell 12 via wire ties 30 and washers 32 and the like. By way of example only, wire ties 30 are inserted through the front and back insulating layers 22 and 24, through the hollow cores of each shim 26 and through both faces of the wire mesh shell 12. Opposed outer ends of each wire tie 30 are secured under tension to the washers 32 in order to maintain an inward lateral tension upon opposite sides of the wire mesh shell 12. The front and back faces 4 and 6 are only in direct communication with one another through the wire ties 30 and those portions of the wire mesh shell 12 spanning the separation cracks 18. This minimal amount of direct communication substantially reduces energy transfer. While the shims 26 directly communicate with the opposed insulation layers 22 and 24, these shims include very little surface area through which energy would propagate. Also, the shims only experience the energy potentials that exist on opposite sides of the dead air space 28 which is quite minor, since the front and back faces 4 and 6 and insulation layers 22 and 24 substantially reduce the energy potential between the outer surfaces of the front and back faces 4 and 6.

Figure 3:
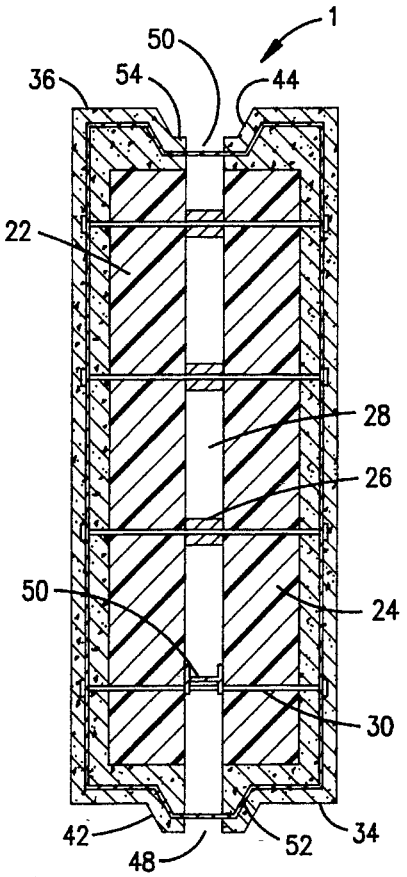
FIG. 3 illustrates a top sectional view of one columnar member according to the present invention taken along line 3—3 in FIG. 1.

FIG. 3 illustrates a top sectional view of adjoining columnar members 1. Each columnar member 1 includes a leading side 34 and a trailing side 36, which include an intersecting tongue 42 and an intersecting groove 44, respectively. The intersecting tongue 42 is formed slightly smaller than the groove 44 allow for expansion of an sealant/caulking material injected therein prior to assembly. The intersecting tongue 42 and groove 44 extend along corresponding lengths of the leading and trailing side 34 and 36, respectively, from a top surface 8 to a bottom surface 10. The intersecting tongue 42 and groove 44 encase U-shaped ridges 52 and 54 formed in the wire mesh shell 12, as explained above. The intersecting tongue 42 and groove 44 also include separation cracks 48 and 50 extending along a length thereof to isolate the front and back faces 4 and 6. Only the U-shaped ridges 52 and 54 within the wire mesh shell 12 span the separation cracks 48 and 50. As explained above, the U-shaped ridges 52 and 54 maintain the integrity of the tongue 42 and groove 44 arrangement used to combine adjoining columnar members.

Alternatively, the front and back isolation layers 22 and 24 may be separated by support beams 56 (FIG. 3), such as metal I-beams or H-beams. The support beams 56 extend along a length of the columnar member 1, such as from a top to a bottom thereof. The support beams 56 may be used to enhance the structural integrity of the columnar member 1, such as when used to form a roof or other non-vertically oriented structure. When arranged to span a distance, the support beams 56 are oriented to run between the supporting ends thereof (in FIG. 3, the support beam 56 projects perpendicular to the plane of the drawing sheet). The support beams 56 are secured in position with the wire ties 30. For instance, if H or I beams are used, small holes may be bored along the flanges thereof and aligned with the wire ties 30. The wire ties 30 are secured to the washers 32 as explained above.

Figure 4:
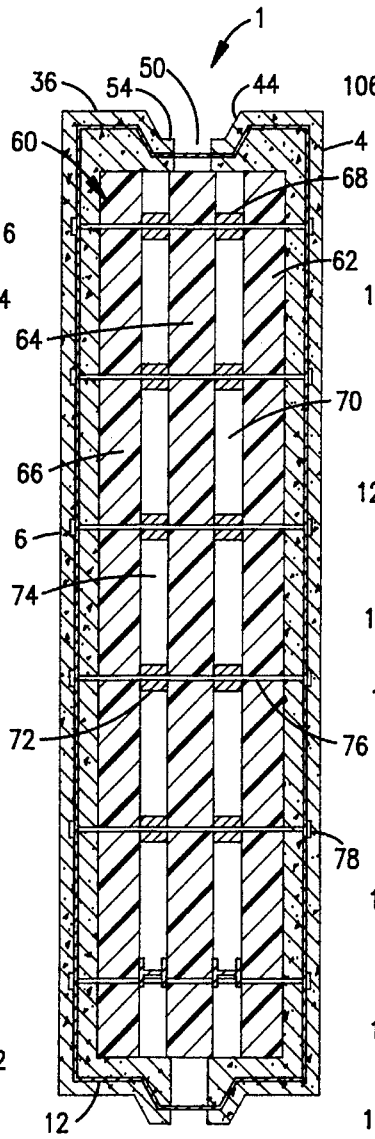
FIG. 4 illustrates a side sectional view of an alternative embodiment which utilizes multiple insulation layers and dead air spaces.

FIG. 4 illustrates a side sectional view of an alternative embodiment in which an insulating core 60 includes front, middle and back insulation layers 62, 64 and 66, respectively. The front and back insulation layers 62 and 66 are located adjacent the front and back faces 4 and 6, respectively, while the middle insulation layer 64 is centered therebetween. The front and middle insulation layers 62 and 64 are separated with a first set of shims 68 to form a first dead air space 70. The middle and back insulation layers 64 and 66 are separated with a second set of shims 72 to form a second dead air space 74. The front, middle and back insulation layers 62, 64 and 66, and the first and second set of shims 68 and 72 are secured to one another through wire ties 76. The wire ties 76 are secured under tension to washers 78 to maintain the insulation core 60 as a single unit. The columnar member of FIG. 4 includes tongue and groove members which substantially resemble those of FIG. 1. Hence, the tongue and groove members are not explained here in detail.

Figure 6:
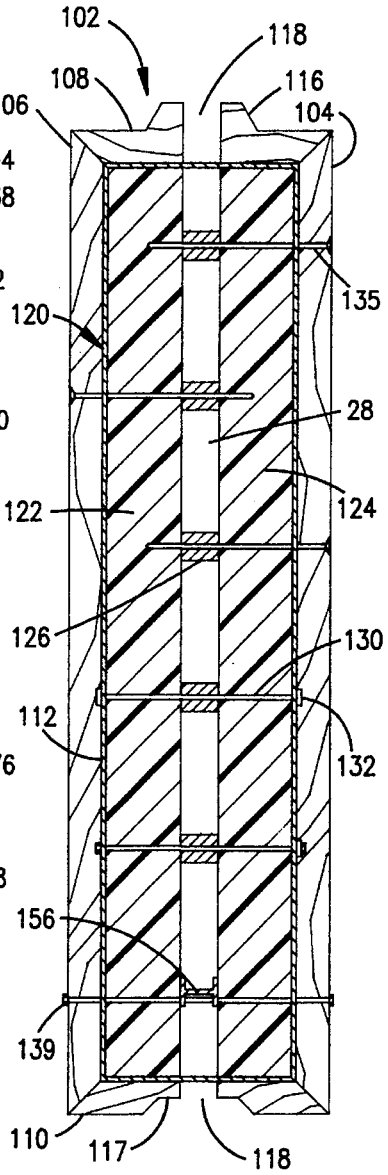
FIG. 6 illustrates a side sectional view of an alternative embodiment which the outer in casing is constructed of wood.
Figure 7:
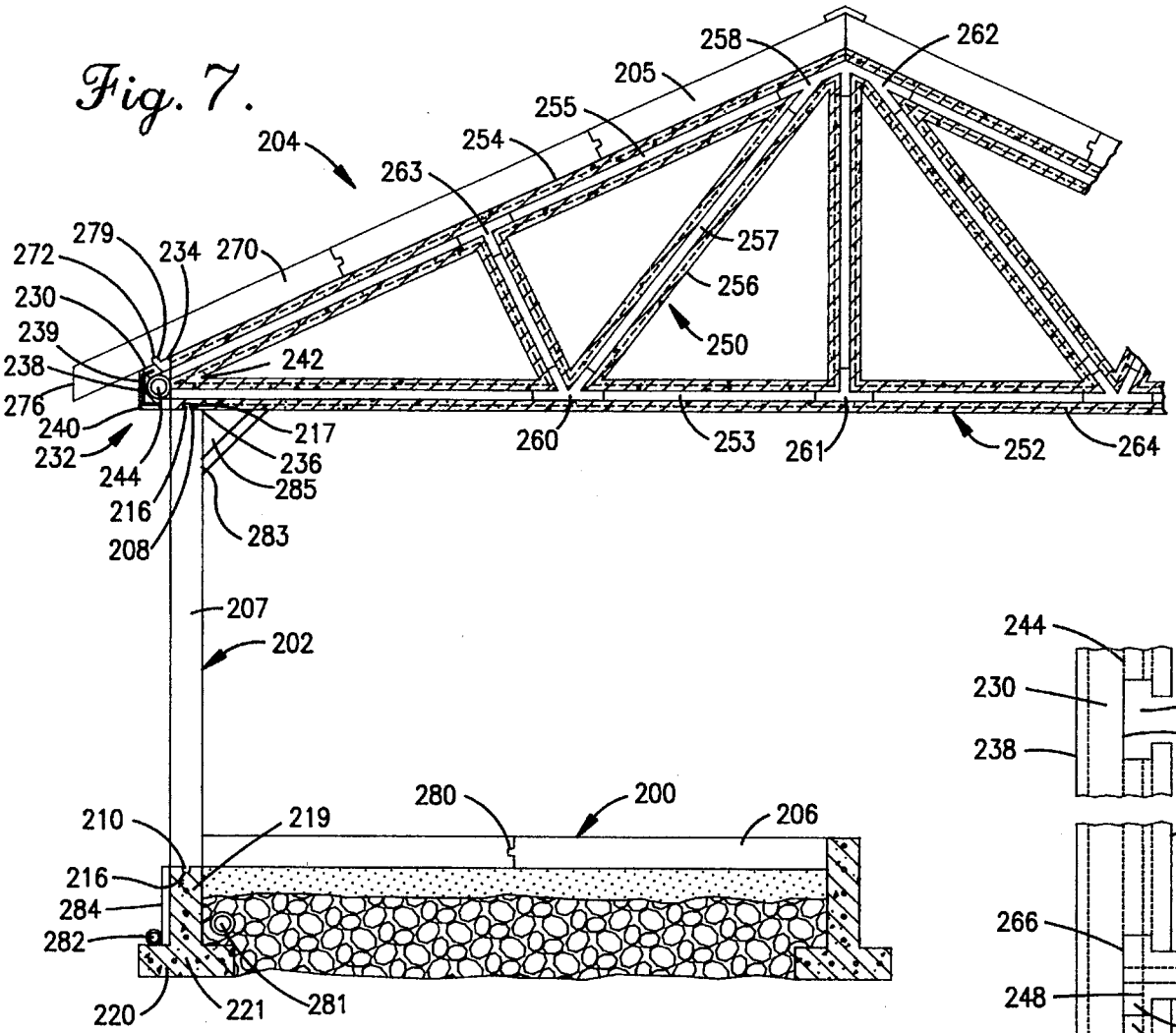
FIG. 7 illustrates a side sectional view of an overall connection of the floor, wall and ceiling sections, along with a truss structure, according to the present invention.

FIG. 7 illustrates a side sectional view of a cut-out portion of a structure according to the present invention exhibiting foundation, floor, wall, truss and ceiling sections that are connected to one another. The floor 200, wall 202 and ceiling 204 sections are composed of multiple columnar members/panels 1 as illustrated in FIGS. 1–4 and 6 with an insulating core having at least one air gap and at least two insulation layers. The panels 1 within the floor 200, wall 202 and ceiling 204 include the wire mesh shell, shims, I-beams and wire ties as explained above, but were omitted from FIG. 7 to avoid undue confusion within the drawing. The wall section 202 support the truss 250 and a top plate 230 which supports the ceiling section 204.

The wall 202 includes multiple wall panels 207 aligned side-by-side and having top and bottom surfaces 208 and 210 with intersecting tongues 216 extending outward therefrom. The wall panels 207 are vertically supported by a stem wall 219 and a footing 220. The stem wall 219 extends below the frost level and the footing 220 includes a base wider than the wall to provide support therefor. The stem wall 219 and footing 220 includes reinforcement bars 221 to add additional strength. The intersecting tongue 216 on the bottom surface 210 fits within a corresponding groove in the stem wall 219 to prevent movement therebetween. Optionally, the stem wall 219 may be constructed with an intersecting tongue 216 on a top surface thereof. The bottom surface 210 of the wall panels 207 include the intersecting groove. In this alternative construction, the intersecting tongue 216 may be formed integral with, or separate from, the stem wall 219. If the intersecting tongue 216 is formed separately, it may be secured to the stem wall 219 with glue, screws and the like.

The top surfaces 208 of the wall panels 207 support a top plate 230 which extends along the length of the underlying wall and serves to connect the wall panels 207 with the truss and ceiling sections 250 and 204. The top plate 230 is formed with a cross-section having a horizontal A-shape with a flat side 232 directed downward and an angled side 234 directed upward. The top plate connector 230 includes interior and exterior faces 236 and 238 directed vertically.

The top plate 230 includes an insulating layer 239 at least about its outer periphery, such as a layer of styrofoam, to further insulate the structure. The top plate 230 includes an outer portion 240 that projects outwardly from the wall panel 207, and an inner portion 242 that is aligned directly above the wall panels 207. The inner portion 242 includes an intersecting groove 217 extending along its length and shaped to receive the intersecting tongue 216 along the top surface of the wall panel 207. The outer portion 240 includes a hollow pipe 244 extending through a length thereof, such as a plastic PVC pipe and the like, to provide additional support therefore. The pipe 244 provides a conduit for electrical and other lines to be run along a length of the wall without being exposed. The pipe 244 also provides an air path to convey air currents along the wall.

As viewed from above (FIG. 8), the top plate 230 includes cut-out regions 246 traversing and extending vertically along a height of the inner portion 242. The cut-out regions 246 are spaced at intervals along a length of the top plate 230. Each cut-out region 246 is formed to receive a T-shaped end 248 of the truss 250. A bottom side of each T-shaped end 248 includes a transverse intersecting groove 249 that aligns with the intersecting groove 217 in the top plate 230. The intersecting groove 249 receives a portion of the intersecting tongue 216 on the top surface 208 of the wall panel 207.

As viewed from the side (FIG. 7), the truss 250 includes a base or ceiling joist 252 extending laterally across the structure between opposite walls thereof. The truss 250 further includes rafters 254 which extend upward from opposite walls of the structure to an apex 258 to define the pitch of the roof. The rafters 254 are connected to the ceiling joist 252 through gussets 256 extending vertically in various directions. In the preferred embodiment, the truss 250 is constructed as a unitary structure. However, optionally the truss 250 may be separated into two pieces near the apex 258 and at a central point along the ceiling joist 252, such as when the truss 250 must span extremely long distances. The two halves of the truss 250 are interconnected through a knuckle connector assembly (not shown).

Each ceiling joist 252, rafter 254, and gusset 256 is formed with substantially the same rectangular cross-section, such as a 6"-by-6". Each ceiling joist 252, rafter 254, and gusset 256 includes a hollow tubular pipe 253, 255 and 257, respectively. The tubular pipes 253, 255 and 257 are interconnected with hollow pipe connectors (as illustrated at points 260–263) to increase the strength of the truss structure. These tubular pipes form a passage throughout the rafter 254 to provide a conduit for electrical lines, air currents and the like. Within the truss 250, the pipes 253, 255 and 257, and connectors 260–263 are surrounded by wire netting 264, such as chicken wire and the like, to provide strength to the structure. The wire netting 264 is wrapped around the pipes and connects multiple times and is embedded within the concrete. When formed, the pipes 253, 255 and 257 and the connectors 260–263 are secured to one another and the wire netting 264 is wrapped therearound and placed in a truss form. Next, the concrete is poured into the truss forms.

Figure 8:
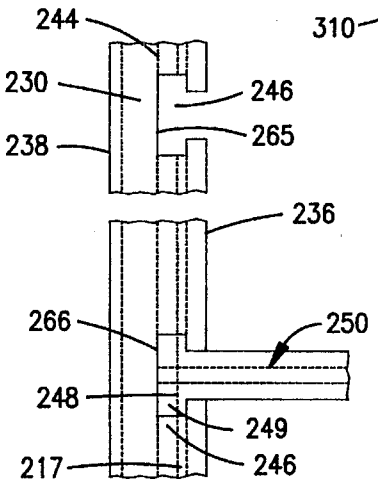
FIG. 8 illustrates a top sectional view of the connection between the truss and top plate.

During installation, the wall panels 207 are erected, and the top plate 230 and the truss section 250 are placed upon the top surface 208. The T-shaped end 248 is slid into the cut-out region 246. Art angled coupler 283 is secured (e.g., screwed, glued, etc.) between the ceiling joist 252 and the wall panels 207 to provide additional support and to provide a void 285 there behind for running electrical wiring and the like. The truss 250 and the top plate 230 are fixed upon the wall panels 207, such that the intersection tongue 216 aligns with the intersecting groove 217 along the bottom of the top plate 230 and the intersecting groove 249 along the bottom of the T-shaped end 248. As illustrated in FIGS. 7 and 8, the pipe 244 is located within the top plate 230, such that a back surface 265 of the cut-out regions 246 is immediately proximate the side of the pipe 244. The pipes 253 and 255 within the truss 250 extend to an outer end 266 of the T-shaped ends 248, such that the top plate pipe 244 and the truss pipe 253 and 255 are immediately adjacent one another. This alignment allows the pipes to be interconnected to enable electrical lines, air currents and the like to be passed therethrough.

The truss section 250 and the top plate 230 supports the ceiling panels 205 which are secured to one another through the intersecting tongue and groove arrangement described above. The ceiling panels 205 may include any of the above discussed insulating core arrangements and include any number of shims and/or supporting beams. The lowest ceiling panel 270 is cut to include an intersection groove 272 proximate the intersecting tongue 279 formed in the angled side 234 of the top plate 230. The intersecting tongue 279, through the groove 272, provides additional support for the ceiling panels 205. The lowest ceiling panel 270 is also cut along its outer end 276 along a substantially vertical line to provide the desired pitch to the outer end 276 thereof. The ceiling panels 205 are securely fastened, such as with glue, along a length of the trusses 250.

The floor panels 206 are also interconnected through the intersecting tongue and groove assemblies 280. The floor panels 206 abut against a lower interior side of the wall panels 207 and/or against the stem wall 219. The floor panels 206 rest upon compacted soil, such as sand, which rests upon a load bearing strata, such a gravel. In the preferred embodiment, the floor panels 206 are not directing affixed to the wall panels 207 or the footings 220 to provide a "floating relation" therebetween. This floating relation is advantageous in unstable soils and in areas that experience a large number of earth quakes.

The footings 220 may include a hollow pipe 281 on an inside thereof which surrounds the structure. The pipe 281 is perforated and allows chemicals such as termite control chemicals to be evenly injected into the ground about the interior of the stem wall 219. Optionally, a drain pipe 282 is buried outside the footings 220 and an insulated foam layer 284 may be buried about the periphery of the stem wall 219. The insulated layer 284 is sufficiently long to extend below the frost level.

The ceiling and wall panels 205 and 207 may be attached to the trusses 250 in such a manner as to provide a passage, such as for electrical lines, air currents and the like along the wall panels 207 and through the ceiling panels 205. This construction allows air to pass along the dead air space 28 within each ceiling panel 205, the pipes and connectors (253, 255, 257 and 260–263) within the trusses 250, along the dead air space 28 within each wall panel 207, and through the dead air space 28 within each floor panel 206. Vents may be cut in the ceiling panels 205, the trusses 250 and the wall panels 207 proximate the floor to allow for air from within the structure to allow air to flow through the passage therethrough. This flow of air currents improves the thermal efficiency of the home by allowing natural (i.e., not forced) air flow about the structure.

Optionally, ski lights may be placed in the ceiling to allow the structure to be used as a passive solar structure. As light passed through the ski lights, it heats the walls, trusses, floors and ceiling panels. These panels retain this heat throughout the day. When night arrives, the panels still contain the heat and emit it into the air passages therethrough. Thus the heat stored in the structural panels is passed back into the rooms in the evening.

The wall panels 207 from adjacent walls meet and form a corner for the structure. At these corner intersections, the panels 207 are cut vertically along an entire side thereof at a 45° angle such that adjoining corner side panels 207 form a 90° angle with one another. This 45° cut extends through the front and back faces 4 and 6, the wire mesh shell 12, the insulation layers 22 and 24, and the air gap 28. When placed in an assembled position, the interior/front faces 4 of adjoining panels 1 securely abut against one another along this 45° cut. The exterior/back faces 6 of adjoining panels also abut against one another. An L-shaped connector (not shown) is positioned vertically along a length of the intersection between adjoining exterior/back faces 6. The L-shaped connector is securely fastened to both exterior back faces 6 to provide additional support for the vertical intersection between adjoining corner wall panels 1.

The interior walls within the structure (also referred to as short walls) may be constructed without the insulated core. Instead, these walls merely may include a soft core, such as cardboard, surrounded by wire netting.

Figure 9:
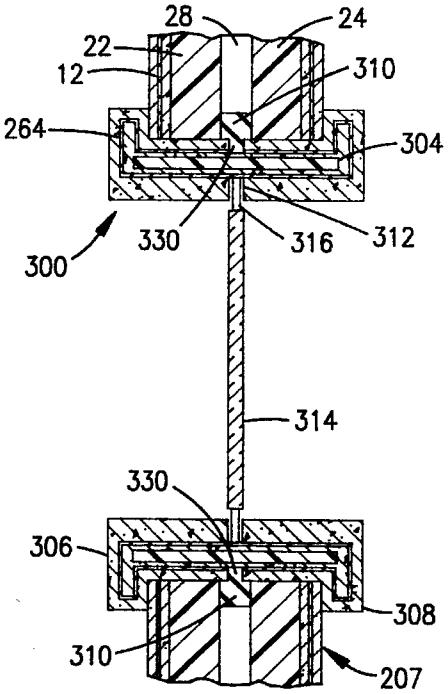
FIG. 9 illustrates a top sectional view a window jam structure inserted between two wall panels.

FIG. 9 illustrates a cross-sectional view of a door or window jam utilized in connection with the present invention. The present door and window jams provide good thermal insulating characteristics and provide additional support for the structure. Each section of the door and window jams are constructed with the same manner and from the same materials. Thus, the side jams are illustrated as exemplary. Each jam 300 is constructed with a U-shaped cross-section, the recessed portion of which is oriented to receive a corresponding wall portion of the panel 207 receiving the door or window. Each jam 300 is formed with an insulated core 304, such as a foam core, aligned in a direction substantially perpendicular to the wall. The insulated core 304 extends slightly beyond the width of the wall panels 207. The insulated core 304 is surrounded by wire netting 264, such as "chicken" wire and the like. While illustrated as a single layer, the wire netting may be wrapped multiple times around the core 304 to further strengthen the jam 300. The jam 300 includes interior and exterior ends 306 and 308 that project beyond the wall panels 207. Caulking 310 is injected into each dead air space 328 of the panel 207 surrounding the opening for the door or window prior to inserting the jams 300. Centrally located within the U-shaped section of each jam 300 is a notch 330 which extends into the wire netting 264 in order to further separate the interior and exterior ends 306 and 308 of the jam 300 from one another. The caulking 310 also fills the notch 330 once the jam 300 is installed.

The side jams 300 include a notched recess 312 at an intermediate point and extending inward to the wire netting 264 to thermally separate the ends 306 and 308. Each window or door 314 includes a weather strip 316, such as rubber and the like, securely affixed about its periphery. When installed, the weather strip 316 aligns with, and extends to the back of, the notched recess 312 when the door or window is closed. Doors are constructed in accordance with the above described panel/columnar member 1, with an insulated core having a dead air space therein. The doors also include a separation crack about their periphery. The weather strip 316 is installed in the separation crack. Doors according to the present invention which are made of concrete do not shrink or warp.

To install a door or window, an opening therefor is cut through a wall panel 207 once these panels have been installed. Next, a U-shaped header jam is inserted into the top of the opening. The U-shape is turned upward and the header jam is slid upward to receive the section of the wall forming the top of the opening. Then, the side jams are inserted under the header jam to abut against and vertically support it. Next, a window sill (also having the U-shaped jam structure) is slid downward between the side jams to force the side jams outward. This structure for the doors and windows provides support for the wall having the opening and provides a better insulation factor that existing door and window jams. Existing jams and the caulking surrounding these jams offer approximately an R-2 thermal value, while a jam according to the present invention offers approximately an R-7 value.

The windows may be formed with a frame containing the hinges and a hand crank for opening and closing. Throughout the above description, the notches and separation cracks cut in the ceiling, wall, floor, door and shutter panels do not cut the wire mesh shell therein. This maintains the structural integrity of the panel.

Figure 5:
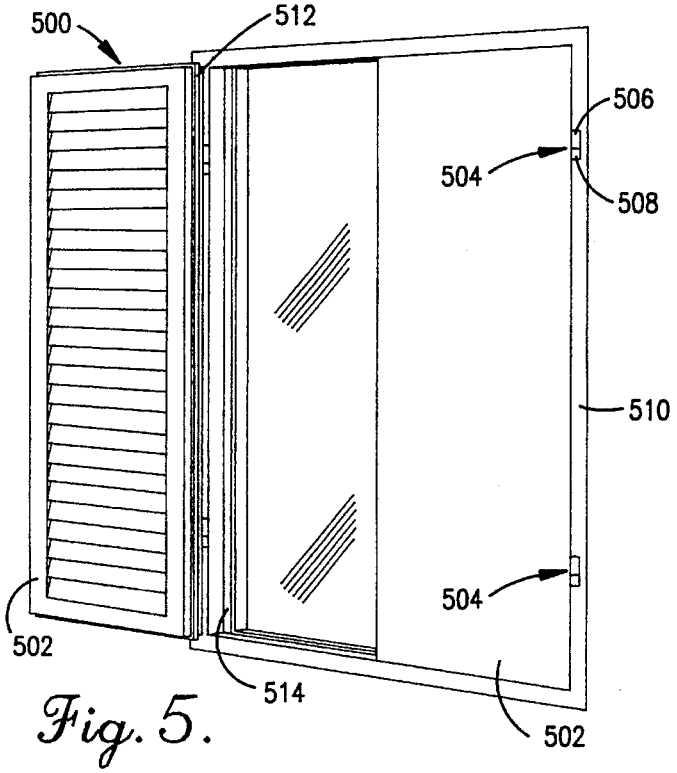
FIG. 5 illustrates a front elevational view of a shutter formed in accordance with the present invention.

FIG. 5 illustrates an elevational view of a shutter 500 which may be constructed according to the instant invention. By way of example only, this shutter may be constructed with an overall thickness of 1¼ inches, with each of the front and back faces, front and back insulation layers and dead air space having a thickness of ¼ inch. The shutter 500 includes two shutter panels 502, each of which is suspended upon hinges 504. The hinges 504 include a first half 506 embedded within or screwed into the corresponding shutter panel 502. The second half 508 of each hinge is secured to the window jam 510. Each shutter panel 502 includes a separation crack (similar to the separation crack 18 explained above), which receives a weather strip 512. The weather strip 512 extends continuously about the perimeter of each shutter panel 502 to effect a seal between the shutter and the window jam 510 when closed. Optionally, the window jam 510 may be constructed with a groove 514 which extends about the inner periphery thereof. If included, the groove 514 is arranged to receive the weather strip 512 when the shutter panels 502 are closed.

FIG. 6 illustrates an alternative embodiment in which the outer casing 102 is formed of wood, plastic or a similar hard material. The front and back faces 104 and 106 are formed with top and bottom surfaces 108 and 110 having a tongue and groove 116 and 117 arrangement thereon. As in the first embodiment, each tongue and groove 116 and 117 is split along a separation crack 118 extending along a length of each top and bottom surface 108 and 110. The front and back faces 104 and 106 receive an insulating core 120 therebetween which substantially resembles that of FIG. 1. The insulation layers 122 and 124 may be separated by shims 126 and/or support beams 156. The insulation core 120 may be secured to the front and back faces 104 and 106 in several manners, such as nails, screws, adhesive and the like. Similarly, the shims 126 and support beams 156 may be secured between the insulation layers 122 and 124 in several manners, such as nails, screws, adhesive and the like. As illustrated in FIG. 6, a wire mesh shell 112 may be constructed along the interior side of the front and back surfaces 104 and 106, and the top and bottom surfaces 106 and 108. The wire mesh shell 112 retains the core 120 in a rectangular shape. However, the shell 112 need not be included in an alternative means is provided to secure the core 120 together. The wire mesh shell 112 may be secured separately to the core through pins 138 and fasteners 139. Alternatively, the shell 112, insulating layers 122 and 124, front and back surfaces 104 and 106, and the shims and/or support beams 126 and 156 may be secured to one another with screws or nails 135, and/or bolts 130 and nuts 132.

Optionally, additional styrofoam layers may be inserted and separated by additional dead air spaces to further enhance the thermal insulating characteristics of the columnar members. Additionally, multiple tongue and groove members may be provided along each side, top and bottom surface of each columnar member as needed. The thicknesses of the front, back, top, bottom and side surfaces, insulating layers and dead air spaces may be varied as dictated by a particular application. Further, the shims and support beams may be intermix in any desired pattern to provide the necessary amount of integrity for a given application. It should be understood that the subject columnar members are not limited to applications within walls and roofs. Alternatively, the instant columnar members may be used as shutters (as illustrated in FIG. 5), doors and the like. When used to form shutters, doors and the like, a single columnar member may be sufficient. Accordingly, it is not necessary to include the tongue and groove arrangement on surfaces not intended to be sealingly received against a similar columnar member.

To better illustrate the thermal advantages of the present invention over conventional structures, the follow Table 1 is provided. Table 1 exhibits the thermal properties (i.e., the R-value) of an insulated wall including a layer of insulation installed next to a board having various thicknesses versus the thermal properties of the same insulation layer and boards when combined with a ¾ inch dead air space.

| Conventional Board Thickness | R-Value of Board With Insulation | R-Value of Board Plus Insulation Next to a ¾" Air Gap |
|---|---|---|
| ⅜ | 3.0 | 5.8 |
| ½ | 3.6 | 6.4 |
| ⅝ | 4.5 | 7.3 |
| ¾ | 5.4 | 8.2 |
| ⅞ | 6.3 | 9.1 |
| 1 | 7.2 | 10 |

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–9 is to be interpreted as illustrative, and not in a limiting sense.

What is claimed is:

1. A thermally insulated structure formed from at least one panel thermally isolating an interior side from an exterior side thereof, each panel comprising:

an outer casing having front and back wall sections forming interior and exterior surfaces of said panel, said casing having top, bottom and side edge sections, located about a periphery of, and interconnecting, said front and back wall sections, said casing having a hollow body between said front and back wall sections;

an insulating core formed within said hollow body, for minimizing a transfer of thermal energy between said front and back wall sections, said insulating core including front and back insulation layers extending along inner surfaces of said front and back wall sections and being separated by an air gap;

a wire mesh shell surrounding said front and back insulation layers; and support means secured to opposite sides of the wire mesh shell proximate the front and back wall sections and traversing said insulating core, for securing the wire mesh shell to the insulating core.

2. A thermally insulated panel according to claim 1, wherein one side section has an intersecting tongue projecting outward along and extending parallel to a length of said side section and an opposite side section has an intersecting groove recessed inward along a length thereof, said tongue and groove having separation cracks extending along a length thereof to isolate the front and back wall sections from one another, said intersecting tongue being sealingly received within a corresponding groove in an adjoining panel.

3. A thermally insulated panel according to claim 1, wherein said outer casing is formed of concrete and said wire mesh shell is embedded therein throughout said front and back wall sections and said side edge sections.

4. A thermally insulated panel according to claim 1, wherein said outer casing comprises concrete mixed with insulating particles and adhesive.

5. A thermally insulated panel according to claim 1, further comprising a separation crack extending along each of said top, bottom and side sections of said outer casing about a perimeter of said panel to isolate said front and back wall sections from one another.

6. A thermally insulated panel according to claim 1, wherein said top, bottom and side sections include means for thermally isolating the front and back wall sections from one another to prevent direct transfer of thermal energy therebetween.

7. A thermally insulated panel according to claim 1, wherein said casing is formed with a substantially rectangular cross section.

8. A thermally insulated panel according to claim 1, wherein said support means includes a plurality of shims, evenly spaced across confronting faces of said front and back insulating layers to maintain said air gap therebetween, said shims having a thickness equal to a desired thickness of said air space.

9. A thermally insulated panel according to claim 1, wherein said support means includes a plurality of support beams traversing, confronting faces of said front and back insulating layers, to provide support for said panel.

10. A thermally insulated panel according to claim 1, further comprising wire ties, extending across a thickness of said panel between said front and back sections thereof, to secure said front and back insulating layers to said front and back wall sections.

11. A thermally insulated panel according to claim 1, wherein said side sections include a tongue and a groove, respectively, which are received by corresponding intersecting tongue and groove arrangements on adjoining panels.

12. A thermally insulated panel according to claim 11, wherein each of said tongues and grooves include separation cracks along a length thereof to prevent direct thermal communication between said front and back wall sections.

13. A thermally insulated panel according to claim 11, wherein said tongue and groove arrangement includes sealant to effect a seal between adjoining panels.

14. A thermally insulated panel according to claim 1, said insulating core further including a middle insulating layer located between said front and back insulating layers.

15. A thermally insulated panel according to claim 14, wherein said middle insulating layer is positioned such that first and second air gaps are maintained on opposite sides thereof and between said front and back insulating layers.

16. A thermally insulated panel according to claim 14, said insulating core further including two sets of shims, a first set of which maintains a first air gap between said front and middle insulating layers, and a second set of which maintains a second air gap between said back and middle insulating layers.

17. A thermally insulated panel according to claim 14, said insulating core further including two sets of support beams, a first set of which supports and maintains a first air gap between said front and middle insulating layers, and a second set of which supports and maintains a second air gap between said back and middle insulating layers.

18. A building having high thermal insulating characteristics which includes walls, a floor, trusses and a ceiling, said walls and ceiling being formed with panels to thermally isolate an interior side from an exterior side, said panels comprising:

front and back faces forming interior and exterior surfaces of said panel, top, bottom and side surfaces, located about a periphery of, and interconnecting, said front and back faces, to form a hollow body between said front and back faces, and an insulating core, formed within said hollow body, for minimizing a transfer of thermal energy between said front and back faces, said insulating core including front and back insulation layers proximate inner surfaces of said front and back faces, an air gap, located between, and separating, said insulation layers, said air gap resisting the transfer of thermal energy therebetween, and support means, located between said insulation layers, to maintain a preselected thickness for said air gap.

19. A building having high thermal insulating characteristics according to claim 18, wherein said trusses are formed with a hollow tubular core surrounded by wire netting and embedded within concrete.

20. A building having high thermal insulating characteristics according to claim 18, further comprising a top plate running along a top surface of at least one of said walls, said top plate including a groove in a bottom surface thereof to receive an intersecting tongue running along a top surface of said walls.

21. A building having high thermal insulating characteristics according to claim 18, wherein said walls and said ceilings are formed from said thermally insulating panels with air gaps therein, said air gaps within said walls and ceiling panels being interconnected with one another and with air vents to provide air circulation through the walls and ceiling and into an interior of said building.

* * * * *